US005850812A

United States Patent [19]

Noguchi

[11] Patent Number: 5,850,812

[45] Date of Patent: Dec. 22, 1998

[54] ENGINE HAVING VARIABLE VALVE TIMING MECHANISM

[75] Inventor: Toshiharu Noguchi, Toyota, Japan

[73] Assignee: Toyota Jidosha Kabushiki Kaisha, Toyota, Japan

[21] Appl. No.: 933,102

[22] Filed: Sep. 18, 1997

Related U.S. Application Data

[63] Continuation of Ser. No. 803,652, Feb. 21, 1997, abandoned.

[30] Foreign Application Priority Data

Feb. 22, 1996 [JP] Japan ..... 8-035037

[51] Int. Cl.[6] ..... F01L 1/344

[52] U.S. Cl. ..... 123/90.17; 123/90.6; 74/568 R

[58] Field of Search ..... 123/90.15, 90.17, 123/90.31, 90.6; 74/567, 568 R; 464/1, 2, 160

[56] References Cited

U.S. PATENT DOCUMENTS

| | | | |
|---|---|---|---|
| 3,258,937 | 7/1966 | Kranc et al. | 64/25 |
| 5,138,985 | 8/1992 | Szodfridt et al. | 123/90.17 |
| 5,247,914 | 9/1993 | Imai et al. | 123/90.17 |
| 5,483,930 | 1/1996 | Moriya et al. | 123/90.17 |

FOREIGN PATENT DOCUMENTS

WO 91/05941 5/1991 WIPO .

*Primary Examiner*—Weilun Lo
*Attorney, Agent, or Firm*—Kenyon & Kenyon

[57] ABSTRACT

An engine includes a crankshaft, a camshaft being driven by the crankshaft for opening and closing intake valves, a variable valve timing mechanism (VVT) attached to one end of the camshaft, which applies torque to the camshaft so as to change the valve timing. The camshaft has an increased outside diameter at a portion adjacent to the VVT as compared to other portions that are more distant from the VVT.

19 Claims, 3 Drawing Sheets

ENGINE HAVING VARIABLE VALVE TIMING MECHANISM

This application is a continuation of application Ser. No. 08/803,621, 21 Feb. 1997, now abandoned.

BACKGROUND OF THE INVENTION

1. Field of the Invention

The present invention relates to an engine having a camshaft for driving an intake valve and exhaust valve. More specifically the present invention relates to an engine having a mechanism located on a camshaft that can change valve timing of intake valves or exhaust valves.

2. Description of the Related Art

Generally, engines have camshafts for driving intake valves and exhaust valves. There are known engines having variable valve timing mechanisms (hereinafter referred to as "VVTs") on the camshafts thereof. The VVT can change the rotational phase of the camshaft with respect to that of a crankshaft so that valve timing of the intake valves or the exhaust valves may be changed. The VVT achieves optimum control of valve timing depending on the operational state (including load, rotational speed, etc.) of the engine which, changes over a wide range, to improve fuel consumption, output and emissions of the engine.

U.S. Pat. No. 5,483,930 discloses an example of an engine having a VVT. This engine has a camshaft provided with a VVT at one end thereof. The camshaft has substantially uniform outside diameter over its entire length. Torque from the crankshaft is transmitted via the VVT to the camshaft. The VVT is provided with a timing pulley that is rotatable relative to the camshaft, a cover fixed to the pulley to cover the corresponding end portion of the camshaft and a ring gear located between the cover and the camshaft. The cover and the ring gear are connected to each other by a helical gear, while the ring gear and the camshaft are likewise connected to each other by a helical gear. A pair of pressure chambers are defined on each side of the ring gear with respect to the axial direction of the camshaft, and hydraulic pressure is supplied selectively to these pressure chambers.

While the engine is under operation, torque from the crankshaft is transmitted to the pulley to rotate the camshaft via the cover and the ring gear. Intake valves are driven by the rotation of the camshaft with a predetermined timing. The VVT is actuated by the hydraulic pressure supplied selectively to the pressure chambers. The ring gear is moved along the teeth of the helical gear by the hydraulic pressure thus supplied. More specifically, the ring gear rotates while it travels axially. This travel of the ring gear is converted to a torque for rotating the camshaft. When the rotational direction of this torque is the same (positive direction) as that of the camshaft, the rotational phase of the camshaft is advanced with respect to the pulley; whereas when it is of the opposite direction (negative direction) to the rotational direction of the camshaft, the rotational phase of the camshaft is retarded with respect to the pulley. Thus, the rotational phase of the camshaft relative to the pulley is changed by the torque generated based on the travel of the ring gear, and the valve timing of the intake valves is changed from a predetermined timing.

However, when the VVT is actuated in the engine, the camshaft is subjected to great torque at a location adjacent to the portion adjacent to the VVT. Thus, distortion is caused in the camshaft by the torque, The distortion is greater at locations nearer to the VVT. Based on such distortion, a change in valve timing of the valves, especially those distant from the VVT, is retarded consequently.

Accordingly, in order to change valve timing of the valves with an accurate response, it is essential that the camshaft be rigid to withstand the torque. Though the outside diameter of the camshaft can be increased in order to enhance its rigidity to increase the outside diameter of the camshaft over its entire length leads to a significant increase in the volume and weight of the camshaft, which increases in the weight of the engine.

SUMMARY OF THE INVENTION

It is an objective of the present invention to provide an engine having a variable valve timing mechanism which enables changing of valve timing of valves with an accurate response without greatly increasing the weight of the engine.

To achieve this, an engine is provided including a crankshaft and a camshaft, which is driven by the crankshaft, for selectively opening and closing either an intake valve or an exhaust valve. A control apparatus is attached to the camshaft, which applies torque to the camshaft so as to change the valve timing. The camshaft has an increased outside diameter at a location near to the apparatus as compared to other portions that are distant from the apparatus.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION (First embodiment)

A first embodiment of the present invention will be described below referring to FIGS. 1 to 3.

Figure 1:
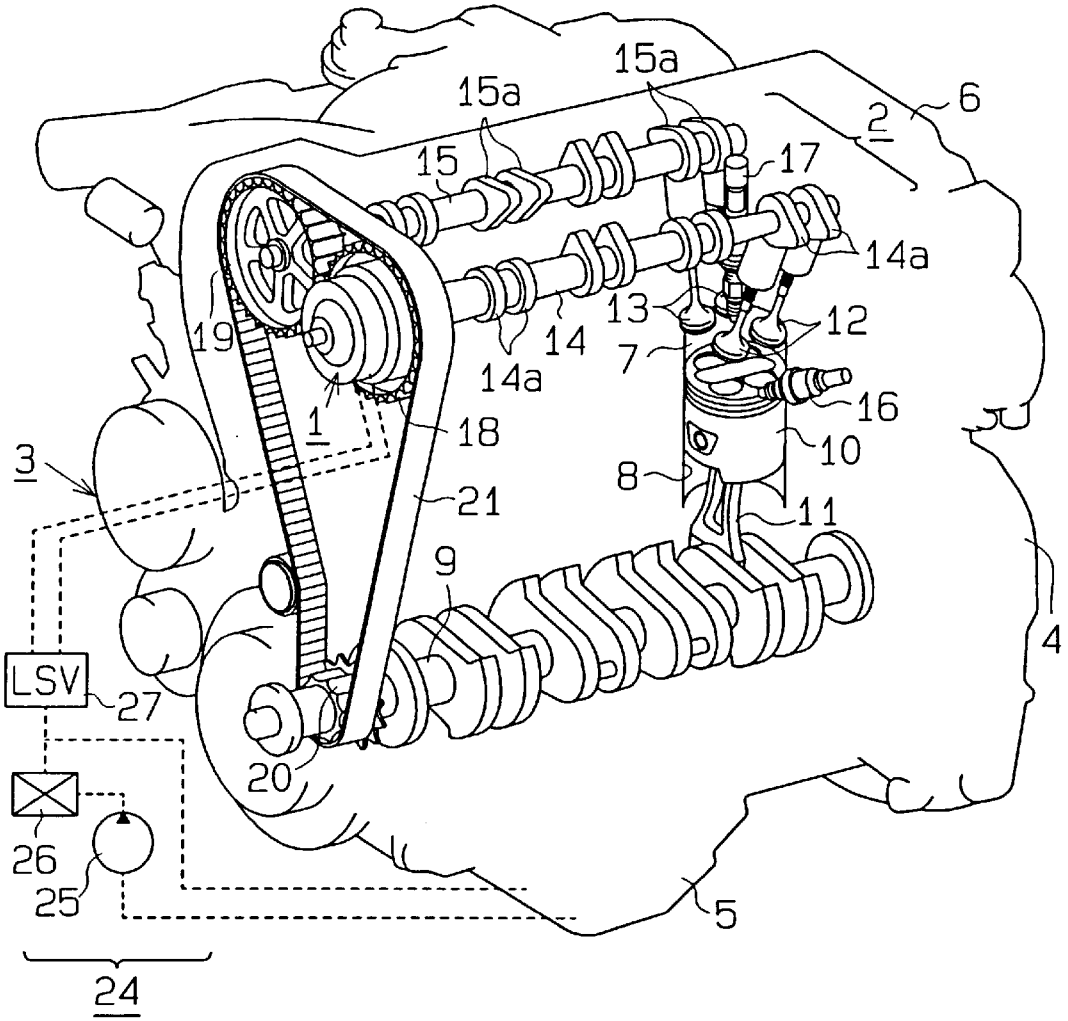
FIG. 1 is a perspective view showing an engine having a variable valve timing mechanism according to a first embodiment of the invention.

FIG. 1 shows an outline of an engine 3 having a variable valve timing mechanism (VVT) 1 and also a valve train 2. The engine 3 contains a cylinder block 4, an oil pan 5 fixed to the bottom of the block 4 and a cylinder head 6 fixed to the top of the block 4. The front of the engine is considered to be the side to which the timing belt 21 of FIG. 1 is connected.

The oil pan 5 stores therein a lubricating oil to be supplied to various parts of the engine 3. The cylinder block 4 has a plurality of cylinders 8 each forming a combustion chamber 7, in this embodiment, while the engine 3 has four cylinders 8, only one cylinder is shown to simplify the drawing, Tho cylinder block 4 rotatably supports a crankshaft 9. A piston 10 is fitted in each cylinder 8 to reciprocate vertically and is connected to the crankshaft 9 via a connecting rod 11.

In the cylinder head 6, a plurality of intake valves 12 and exhaust valves 13 provided in each cylinder 8 selectively open and close intake ports and exhaust ports (neither of which are shown). A pair of camshafts 14, 15 are rotatably supported in the cylinder head 6 parallel to each other. The camshafts 14 and 15 have a plurality of cams 14*a* and 15*a*, respectively. Two adjacent cams 14*a* or 15*a* form a pair. The cams 14*a* and 15*a* drive the valves 12 and 13, respectively. Injectors 16, one of which is provided for the each cylinder 8 in the cylinder head 6, inject fuel into the intake ports. Ignition plugs 17, one of which is also provided for each cylinder 8 in the cylinder head 6, ignite a combustible fuel/air mixture introduced to the respective combustion chambers 7. Timing pulleys 18 and 19 attached to front ends of the camshafts 14 and 15, respectively, and a timing pulley 20 attached to the front end of the crankshaft 9 are connected to one another via a timing belt 21. The VVT 1 attached to the front end portion of the intake-side camshaft 14 includes the pulley 18 and operates to change valve timing of the intake valves 12.

Figure 2:
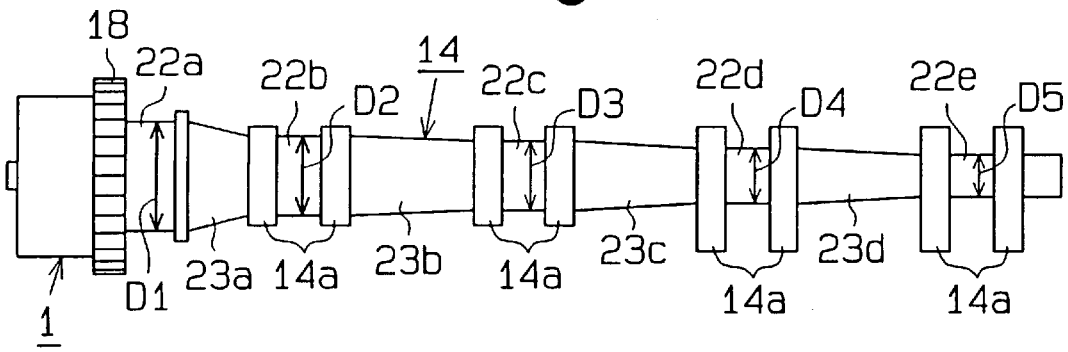
FIG. 2 is a plan view showing the intake-side camshaft and a variable valve timing mechanism of FIG. 1.

FIG. 2 is a plan view showing the intake-side camshaft 14 and the VVT 1. As shown in FIGS. 1 and 2, the camshaft 14 has a first journal 22*a*, a second journal 22*b*, a third journal 22*c*, a fourth journal 22*d* and a fifth journal 22*e* between the respective pairs of cams 14*a*. These journals 22*a* to 22*e* are respectively supported by bearings provided in the cylinder head 6 respectively, The first journal 22*a* has the largest outside diameter D1, and the outside diameters D2, D3, D4 and D5 of the second, third, fourth and fifth journals 22*b*, 22*c*, 22*d* and 22*e* are reduced gradually in this order. On the camshaft 14, portions other than the journals 22*a* to 22*e* and the cams 14*a* constitute first to fourth shaft sections 23*a*, 23*b*, 23*c* and 23*d*, which are tapered. The first shaft section 23*a* has the largest diameter, and the diameters of the second, third and fourth shaft sections 23*b*, 23*c* and 23*d* are reduced gradually in this order. Thus, the camshaft 14 is relatively thick at parts adjacent to the VVT 1 compared with other portions and is thinner at parts away from the VVT.

Incidentally, in this embodiment, the exhaust-side camshaft 15 has the same structure as that of the prior art, and the outside diameter of portions other than the cams 15*a* are substantially the same irrespective of the distance from the pulley 19.

While the engine 3 is operating, the torque of the crankshaft 9, which is rotated by the vertical reciprocation of the pistons 10, is transmitted via the belt 21 to the pulleys 18, 19. When the pulleys 18, 19 are rotated with the rotation of the crankshaft 9, the camshafts 14, 15 are rotated synchronously with the rotation of the crankshaft 9. When the camshafts 14, 15 are rotated, the intake valves 12 and the exhaust valves 13 are opened and closed. In this state, the camshafts 14, 15 are rotated synchronously with the rotation of the crankshaft 9, and the valves 12, 13 are driven with a predetermined valve timing based on the rotation of the camshafts 14, 15.

The VVT 1 is controlled by a hydraulic pressure supply unit 24 employing lubricating oil as a hydraulic fuel. As shown in FIG. 1, this unit 24 contains a pump 25, a filter 26 and a linear solenoid valve (LSV) 27. The pump 25 draws and delivers the lubricating oil from and to the oil pan 5. The filter 26 filters the oil delivered from the pump 25. The LSV 27 supplies the oil passed through the filter 26 to the VVT 1 and also feeds back the oil discharged from the VVT 1 to the oil pan 5.

Figure 3:
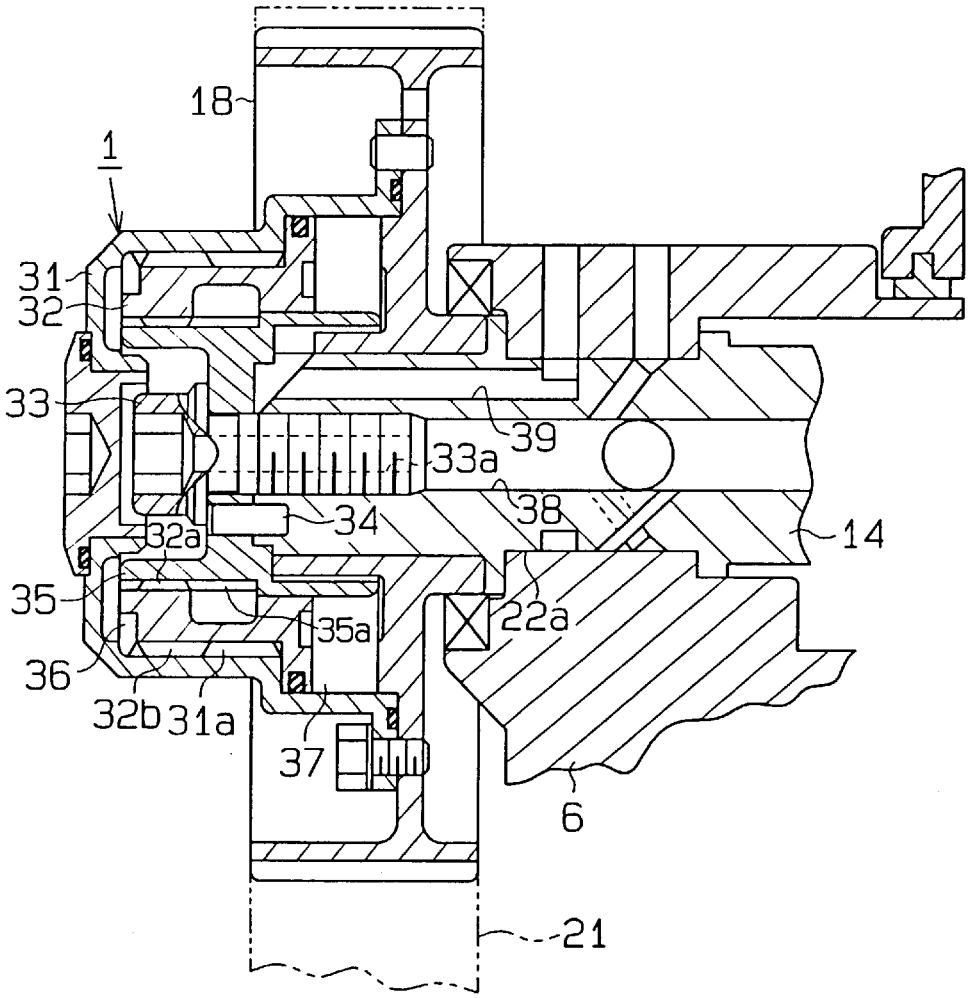
FIG. 3 is a cross-sectional view showing the structure of the variable valve timing mechanism of FIG. 2.

FIG. 3 is a cross-sectional view showing the structure of the VVT 1.

As shown in FIG. 3, the VVT 1 includes, in addition to the pulley 18, a cover 31 fixed to the pulley 18 and a ring gear 32 located between the cover 31 and the camshaft 14.

A cylindrical inner gear 35 is fixed to the front end of the camshaft 14 by a hollow bolt 33 and a pin 34. The inner gear 35 thus forms an extension of the camshaft 14. The inner gear 35 has external teeth 35*a* on the outer circumference thereof. The pulley 18 and the cover 31 are supported rotatably with respect to the camshaft 14. The cover 31 has internal teeth 31*a* on the inner circumference thereof. The internal teeth 31*a* and the external teeth 35*a* are helical splines.

The ring gear 32 couples the inner gear 35 to the cover 31 The ring gear 32 has internal teeth 32*a* and external teeth 32*b*. These teeth 32*a* and 32*b* are helical splines. The internal teeth 32*a* are meshed with the external teeth 35*a* of the inner gear 35, while the external teeth 32*b* are meshed with the internal teeth 31*a* of the cover 31. Inside the cover 31, to each side of the ring gear 32, is a pressure chamber, i.e., a first pressure chamber 36 and a second pressure chamber 37. An oil passage 38 is defined in the camshaft 14 to communicate through the bore 33*a* of the hollow bolt 33 to the first pressure chamber 36. Another oil passage 39 is defined in the camshaft 14 and the inner gear 35 to communicate to the second pressure chamber 37. The hydraulic pressure supplied from the hydraulic pressure supply unit 24 (see FIG. 1) is fed selectively through the oil passages 38, 39 to the pressure chambers 36, 37.

While the engine 3 is operating, hydraulic pressure is selectively supplied to the pressure chambers 36, 37 so as to actuate the VVT 1 and thus rotate the ring gear 32 as it travels along the axis of the camshaft 14. The travel of the ring gear 32 applies a torque to the camshaft 14. This torque changes the rotational phase of the camshaft 14 with respect to the pulley 18. Consequently, the valve timing of the intake valves 12 is changed. The ring gear 32 in able to travel within a predetermined range in the axial direction of the camshaft 14. The amount of change in the valve timing depends on the amount of travel of the ring gear 32. In this embodiment, the hydraulic pressure values in the pressure chambers 36, 37 are controlled to suitably adjust the balance between the hydraulic pressure in the pressure chamber 36 and that in the pressure chamber 37. This adjustment maintains the ring gear 32 at a desired position within the predetermined traveling range. Thus, valve timing of the intake valves 12 is change controlled.

According to the embodiment described above, while the VVT 1 is actuated, the camshaft 14 receives a torque (torsional load) from the VVT 1. However, since the outside diameter D1 of the first journal 22*a* located adjacent to the VVT 1 is greater than that of each of the other portions, the camshaft 14 has a high rigidity so as to withstand that torque. Further, since the outside diameters D2 to D5 of the other journals 22*b* to 22*e* are reduced stepwise from the first journal 22*a*, an increase in the overall volume and weight of the camshaft 14 is limited. Accordingly, the rigidity of the camshaft 14 against the load applied by the VVT 1 under actuation is increased effectively, and the valve timing of the intake valves 21 driven by the shaft 14 is changed with a very accurate response.

Since the first journal 22*a* has a relatively large outside diameter D1, machining of the oil passages 38, 39 to be defined in the camshaft 14 is relatively easy, Incidentally, the timing pulleys 20, 18, 19 may be replaced with sprockets, and the timing belt 21 may be replaced with a chain.

The present invention may be carried out in other embodiments to be described below, which result in similar advantages and effects to those in the foregoing embodiment.

To avoid a redundant description, like or same reference numerals are given to those components which are like or the same as corresponding components of the first embodiment.

(Second embodiment)

A camshaft 41 of the second embodiment has a different shape from that of the camshaft 14 in the first embodiment.

Figure 4:
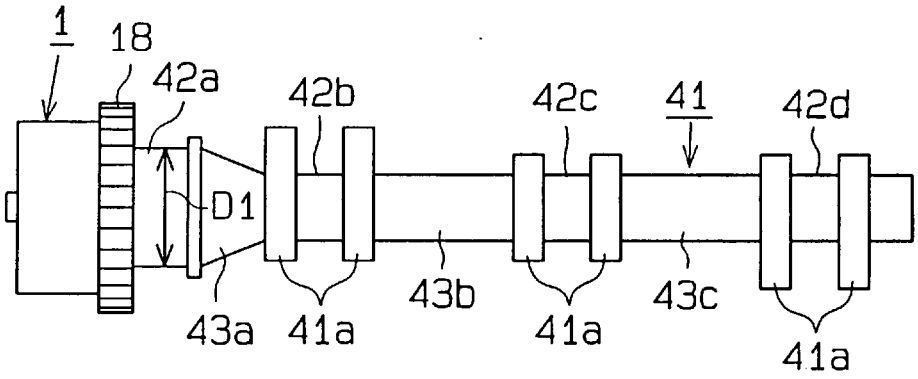
FIG. 4 is a plan view showing a camshaft and a VVT according to a second embodiment of the invention.

As shown in FIG. 4, the VVT 1 is attached to the front end of the camshaft 41. The camshaft 41 has three pairs of cams 41*a*. This camshaft 41 is employed in an engine having three cylinders. In the camshaft 41, only a first journal 42*a* located closest to the VVT 1 is given an increased outside diameter D1 and only a shaft section 43*a* located next to the journal 42*a* is tapered. The outside diameters of the other journals 42*b*, 42*c*, 42*d* and of the other shaft sections 43*b*, 43*c* are uniform. According to this embodiment, machining of the camshaft 41 is relatively easy as compared with the camshaft 14 of the first embodiment.

(Third embodiment)

A camshaft 51 having a different shape from that of the camshaft 14 or 41 in the foregoing embodiments is employed in a third embodiment.

Figure 5:
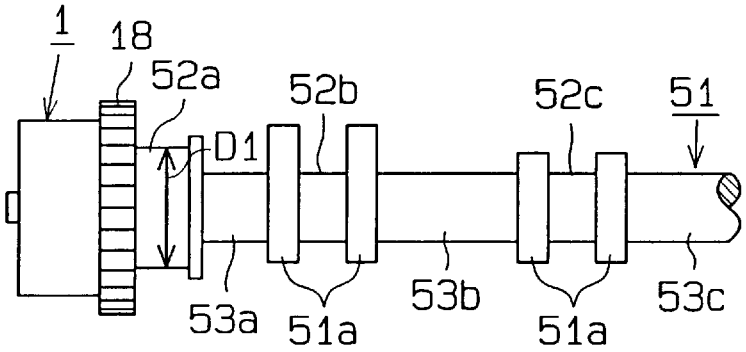
FIG. 5 is a plan view showing a camshaft and a VVT according to a third embodiment of the invention.

As shown in FIG. 5, the VVT 1 is attached to the proximal end of the camshaft 51. This camshaft 51 has plural pairs of cams 51*a*. In the camshaft 51, only a first journal 52*a* located adjacent to the VVT 1 is given an increased outside diameter D1, and the outside diameters of the other journals 52*b*, 52*c* and of shaft sections 53*a*, 53*b*, 53*c* are uniform. According to this embodiment, machining of the camshaft 41 is relatively easy.

Although three embodiments of the present invention have been described herein, it should be apparent to those skilled in the art that the present invention may be embodied in many other specific forms without departing from the spirit or scope of the invention. Particularly, it should be understood that the invention may be embodied in the following forms.

Figure 6:
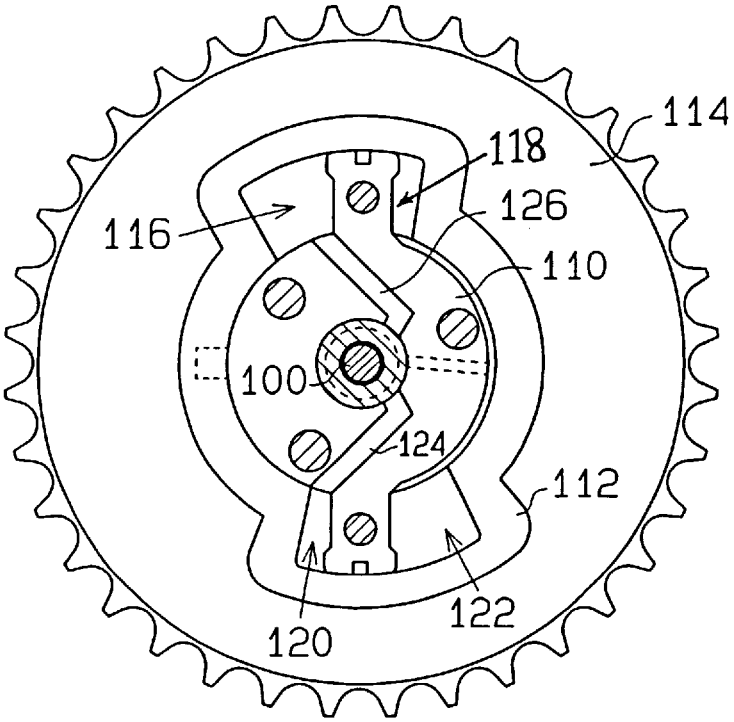
FIG. 6 is a diagrammatic cross sectional view showing a vane type VVT.

The present invention may be embodied in engines provided with other types of VVTs. While there are various possible types of VVTs, the present invention can be applied to any desired type of VVT so long as it can substantially change the rotational phase between the camshaft and a rotor. For example, a vane type VVT as shown in FIG. 6 may be employed. A vane type VVT like that shown in FIG. 6 is described in detail in U.S. Pat. No. 5,107,804, which is incorporated herein by reference. The vane type VVT, which is fixed to the end of the camshaft 100, has a vaned rotor 110, a housing 112 surrounding the rotor and a sprocket 114, The sprocket 114 and the housing 112 are integral and are rotatable with respect to the camshaft 100 and the rotor 110. Further, this VVT has pressure chambers 116–122 on each side of the vanes, the chamber 116–122 being formed by cooperation between the vanes on the rotor 110 and the housing 112. The sprocket 114 is connected to the crankshaft with a timing chain (not shown). By selectively applying hydraulic pressure to the hydraulic chamber 116, 120 through passages 124, 126, the camshaft 100 can be rotated clockwise or counter clockwise with respect to the sprocket 114. Therefore, it functions like the VVT of the first embodiment.

The VVT 1 may be designed to supply hydraulic pressure to only one of the pressure chambers 36 and 37. In this case, the VVT 1 has a device for urging the ring gear 32 in an opposite direction.

Further, the VVT 1 may be fixed not to the intake-side camshaft 14, 41 or 51 but to the exhaust-side cam shaft 15, and the outside diameter of the camshaft 15 is increased at a location adjacent to the VVT 1.

Otherwise, the camshafts 14, 41 or 51 and 15 may be given large diameters, and VVTs 1 may be fixed to both of them so as to change valve timing of the intake valves and exhaust valves.

In addition, the number of cams 14*a*, 41*a* or 51*a* provided on the camshaft 14, 41 or 51 may be changed depending on the number of valves in the engine 3.

Therefore, the present examples and embodiments are to be considered as illustrative and not restrictive, and the invention is not to be limited to the details given herein, but may be modified within the scope and equivalence of the appended claims.

What is claimed is:

1. An engine comprising:

a valve;

a crankshaft, a camshaft driven by the crankshaft for selectively opening and closing said valve; and a valve timing control apparatus, which applies torque to the camshaft to change the valve timing, attached to a proximal end of the camshaft, wherein the camshaft is supported at the proximal end by a proximal end journal, and wherein the camshaft has a distal section, which is distal of the proximal end journal, wherein at least one cam is located on the distal section, and wherein the distal section has an outside diameter at a portion remote from the valve timing control apparatus that is less than the outside diameters of other portions of the distal section that are closer to the valve timing control apparatus.

2. The engine according to claim 1, wherein the engine has a plurality of valves, and wherein the camshaft includes a plurality of cams for driving the valves, a plurality of journals for supporting the camshaft and a plurality of shaft sections joining the cams to the valve timing control apparatus.

3. The engine according to claim 2, wherein the plurality of cams form cam pairs, and each journal is located between the cams forming a corresponding pair, and one of said shaft sections is located between adjacent cam pairs.

4. The engine according to claim 3, wherein each journal has a diameter that is greater than any other of the journals that is more distant from the valve timing control apparatus.

5. The engine according to claim 3, wherein the outside diameters of the shaft sections are reduced at positions that are more distant from the valve timing control apparatus.

6. The engine according to claim 5, wherein the shaft sections are tapered.

7. The engine according to claim 6, wherein the camshaft has eight cams forming four pairs.

8. The engine according to claim 1, wherein the engine has a plurality of intake valves, and wherein the camshaft serves to open and close the intake valves.

9. The engine according to claim 2, wherein the outside diameter of the proximal end journal is greater than the other journals, while the shaft section located closest to the control apparatus is tapered, and the other journals and shaft sections have uniform outside diameters.

10. The engine according to claim 1 wherein the control apparatus has a first rotating member, which is rotated in a fixed phase relationship with the crankshaft, a second rotating member, which is rotated in a fixed phase relationship with the camshaft and an actuating means for changing rotational phase relationship between the second rotating member and the first rotating member.

11. The engine according to claim 10, wherein the actuating means is a cylindrical ring gear having helical splines on its outer circumference and inner circumference.

12. The engine according to claim 10, wherein the actuating means is a vane means that cooperates with a housing to form a hydraulic chamber.

13. A camshaft for use in an engine provided with a valve timing control apparatus for changing the valve timing of at least one of an intake valve and an exhaust valve, wherein the control apparatus is attached to a proximal end of the camshaft, wherein the camshaft is supported at the proximal end by a proximal end journal, the camshaft comprising:

a distal section that is distal of the proximal end journal, wherein at least one cam is located on the distal section, and wherein the distal section has an outside diameter at a portion remote from the valve timing control apparatus that is less than the outside diameters of other portions of the distal section that are closer to the valve timing control apparatus.

14. The camshaft according to claim 13, further comprising a plurality of valves, a plurality of cams for driving the valves, a plurality of journals supporting the camshaft and a plurality of shaft sections for joining the cams to the control apparatus.

15. The camshaft according to claim 14, wherein each journal has a diameter that is greater than any other of the journals that is more distant from the control apparatus.

16. The camshaft according to claim 15, wherein the outside diameters of the shaft sections are reduced at positions that are more distant from the control apparatus.

17. The camshaft according to claim 16, wherein the shaft sections are tapered.

18. An engine comprising:

a plurality of valves;

a crankshaft;

a camshaft driven by the crankshaft for selectively opening and closing said valves, wherein the camshaft has a proximal end, a distal end, a plurality of cams for actuating the valves, and a plurality of journals including end journals located at the distal and proximal ends, respectively; and a valve timing control apparatus, which applies torque to the camshaft to change the valve timing, attached to the proximal end of the camshaft, wherein the camshaft is supported at the proximal end by the proximal end journal, and wherein the camshaft has a distal section, which is distal of the proximal end journal, wherein the cams are located on the distal section, and wherein the distal section has an outside diameter at a portion remote from the valve timing control apparatus that is less than the outside diameters of other portions of the distal section that are closer to the valve timing control apparatus.

19. The engine of claim 18, wherein the proximal end journal is located between the distal section and the valve timing control apparatus, and wherein the distal section is separated from the proximal end journal by a predetermined axial distance.

* * * * *